US005105711A

United States Patent [19]

Barnard

[11] Patent Number: 5,105,711

[45] Date of Patent: Apr. 21, 1992

[54] REMOVABLY MOUNTABLE EFFECTS DEVICE FOR AN ELECTRIC GUITAR

[76] Inventor: Timothy J. Barnard, 1364 Grace Ave., Rochester Hills, Mich. 48309-4357

[21] Appl. No.: 606,495

[22] Filed: Oct. 31, 1990

[51] Int. Cl.[5] ..... G10H 3/26

[52] U.S. Cl. ..... 84/744; 84/737; 84/742

[58] Field of Search ..... 84/743, 744, 644, 670, 84/718, 719, 723, 737, 738, 739, 740, 741, 742, 313, 322, DIG. 30

[56] References Cited

U.S. PATENT DOCUMENTS

| | | | |
|---|---|---|---|
| 4,078,464 | 3/1978 | Sugiyama | 84/744 |
| 4,621,557 | 11/1986 | Newell | 84/704 |
| 4,907,483 | 3/1990 | Rose et al. | 84/740 |
| 4,974,486 | 12/1990 | Wallace | 84/609 |
| 5,007,324 | 4/1991 | De Michele | 84/741 |

*Primary Examiner*—William M. Shoop, Jr.
*Assistant Examiner*—Helen Kim
*Attorney, Agent, or Firm*—Lynn E. Cargill

[57] ABSTRACT

A removably mountable multiple effects device for an electronic signal processor for an electric guitar having an output socket is disclosed which includes a selection panel for accessing and selecting multiple effects from the signal processor contained therein, a jack for plugging into the output socket of the guitar, a power source for supplying power to the signal processor and an output signal device for communicating the signals. The selection panel may be a keyboard which is mounted on the guitar face having easy accessibility to the fingers of the guitar player. The keyboard provides the guitar player with access to any multiple effect accessible by the signal processor, such as tremelo, echoing, and many others, on the face of the guitar rather than having an access to such multiple effects in a remote location. The keyboard or selection panel may also be designed to not only provide the ability to select and access various effects from the signal processor, but may also be designed to enable the musician to program in desired effects.

32 Claims, 1 Drawing Sheet

FIG 1
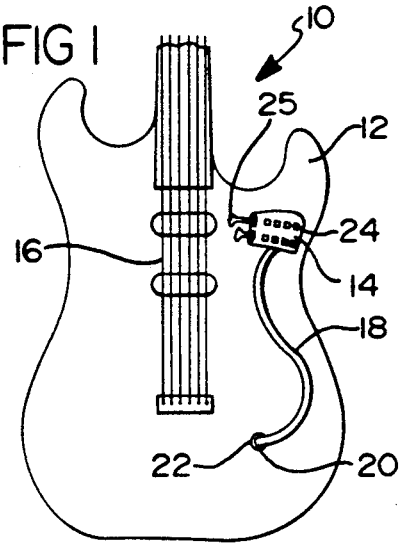
FIG 2
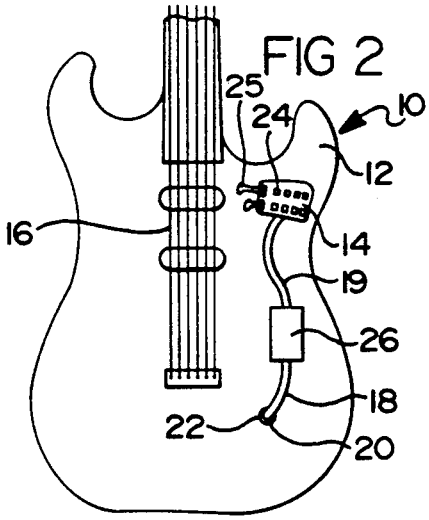
FIG 3
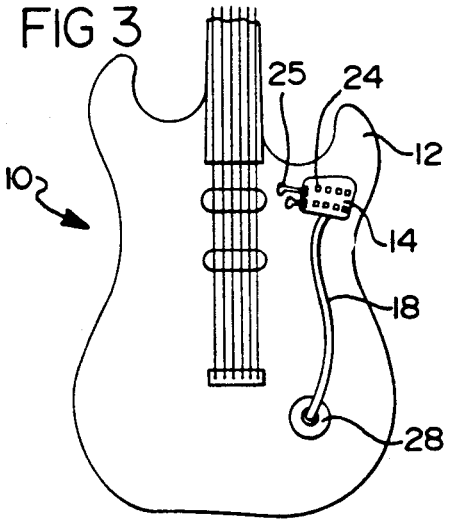
FIG 4
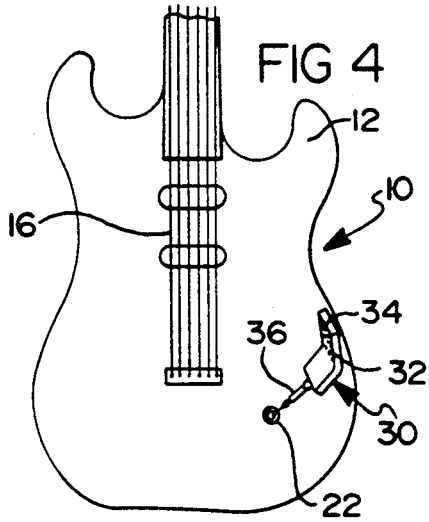
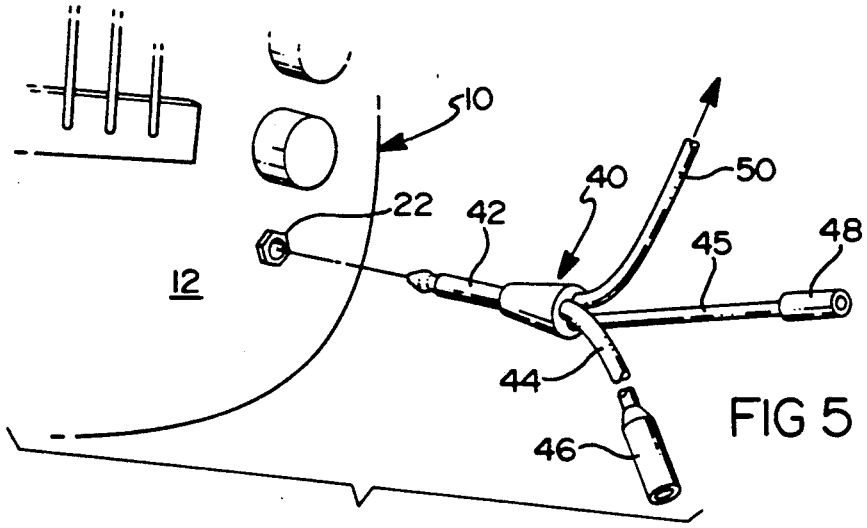
FIG 5

REMOVABLY MOUNTABLE EFFECTS DEVICE FOR AN ELECTRIC GUITAR

TECHNICAL FIELD

The present invention generally relates to sound modifications for guitars and more particularly, is concerned with a mountable multiple effects device for an electronic signal processor for an electric guitar.

BACKGROUND OF THE INVENTION

Recently, electronic gadgets for sound modification on electric guitars have become very popular. Not only are there hundreds of electronic gadget boxes on the market, but older models are constantly being redesigned and reevaluated. Consumers of these electronic gadgets generally purchase ones which produce the sound modifications they desire after evaluating the effects on a mechanical, electronic and sonic basis. The gadgets are purchased to do such things as change the sound of the guitar, add harmony lines, create echoes, multiply the sound of one instrument into two, and many more musical effects. These special effects devices offer a number of benefits to the musician. Musicians can create sounds which were previously obtainable only in recording studios. For example, a musician may record a solo recording on one tape track, then rewind the tape in a recording studio then put down another identical solo recording, thereby producing a fuller sound. Techniques like this now exist with the use of an electronic box which produces the effect within a guitar itself.

However, there are certain things that these electronic boxes are not able to do for a musician, including making the musician sound like a famous star. Like any other aspect of a musical instrument, the effects boxes may not be just plugged in and played. Many controls and options offer nearly limitless varieties of sounds to the musicians, however, they must be utilized like any other musical instrument. Generally, this involves many hours of practice.

Furthermore, musicians are intimidated by the electronic gadgets due to their lack of knowledge of electronics and instrumentation. Sound processors, or electronic boxes, which are currently on the market may be activated by foot pedals or require a separate remote operator to control tabletop or rack mount models. In the past, these effects, although desirable to musicians, having been difficult to operate, difficult to install, and require a great deal of maintenance and attention by persons other than the musician himself.

There are two basic ways to hook effects together. Effects may be strung together one after another in a serial fashion, or effects may be connected in parallel. Most pedal boards use series connections of effects. By mixing the outputs of various effects together in parallel, the effects may have a combined sound. These connections are more complex than series connections because an additional output mixer is generally needed. In order to increase sonic flexibility, mixers and other instruments have become necessary. Moreover, connection of the effects may be put together in a series/parallel configuration, thereby including elements of both series and parallel connections. Although these various combinational possibilities can represent nearly an unlimited way of connecting the effects together for a customized sound, musicians are often confused about how to connect their effects for the best results. In the past, attempts have been made to minimize the connections necessary for these effects and the multitude of electronic boxes and gadgets to produce the desired musical sound. Digital processors have been developed to alleviate these problems, but they are only available in rack mount units, floor pedals, wireless attachments, remote accesses and MIDI converters.

Sound processing is the alteration of the characteristics of sound. Sound processing techniques are employed to create special effects. Although sound processing may produce a multitude of different effects and sounds, the ways in which sounds can be physically modified are quite limited. Basically, the effects are limited to the alteration of the sounds, frequency curve, volume, dynamics, phase or pitch. Further sound processing will add to the basic sound and qualities of echo, reverberation or additional harmonics.

The principals of sound processing are generally the same, whether the electronics are built into the amplifier, or whether they are in the form of separate effects units, floor pedals, ,or rack mount studio devices. Sound processing includes controlling the tone by simple treble, mid-range and base controls, sophisticated equalizers, volume and distortion effects, phasing, flanging and delay. Filters can be designed to eliminate or pass desired frequencies or bands of frequencies. These effects may be individually accessed by volume modifiers, limiters and compressors, tremelo units, noise gates, flangers and phasers, reverb units, or they may be combined together in a multi-effects unit. Recently, there has been a trend towards these larger, more flexible multi-effects units. They combine various functions in one box, where they were previously available only as separate units. The best known of the multi-effects units are made by Rowland, Yamaha, Ibanez and Korg. For example, the Rowland GM-70 GR-MIDI converter converts the guitar's performance into MIDI data that drives synthesizers, samples, sequences or any other MIDI instrument. Yamaha produces a model entitled REX 50 digital multi-effects processor which includes distortion effects, and pre-set effects which are capable of modifying sound and displaying the selected effects on an LCD display. Ibanez produces a digitally controlled processor (DCP) model PDM1 in an effects pedal configuration which gives access to multiple sounding effects.

U.S. Pat. No. 4,516,462 issued May 14, 1985 to Schulze discloses a device for controlling tremelo effects and electronic sound effects in an electric stringed instrument which includes a manipulable means for producing tremelo effects.

U.S. Pat. No. 4,484,508 issued Nov. 27, 1984 to Nourney discloses a guitar having a built-in plurality of vibratile tone generators, whose oscillations are converted into alternating current by electroacoustic transducers. The guitar is provided with a control circuit feedback for a regenerative vibratory signal of progressively diminishing amplitude to maintain the oscillations of a previously activated tone generator for a selected fade-out.

U.S. Pat. No. 4,481,854 issued Nov. 13, 1984 to Dugas discloses an electrical stringed and fretted musical instrument which has at least two pick-ups and a bass boost filter means and a high boost filter means. A single joy stick control varies all of these magnitudes simultaneously. The joy stick control is located on the face of the guitar.

U.S. Pat. No. 4,305,320 issued Dec. 15, 1981 to Peavey discloses a selector switch for musical instruments such as electric guitars which are provided with a palm switch that can be manually activated so that any of the various pick-ups of the guitar can be actuated. The selector switches are located on the face of the guitar as illustrated.

U.S. Pat. No. 4,235,144 issued Nov. 25, 1980 to Lubow et al. discloses a means for controlling special musical effects in synchronism with picking a string of a stringed musical instrument by a pick. The pick includes a conductive portion and a non-conductive portion so that picking a string by the conductive portion initiates a special musical effect, while picking the string with the non-conductive portion results in the instrument operating in a conventional manner without the special musical effects.

It is an object of the present invention to provide an electronic signal processor for an electric guitar which includes a removably mountable multi-effects signal processor which has a selection panel for accessing and selecting multiple effects.

It is another object of the present invention to provide an electronic signal processor for an electric guitar which includes a keyboard for selecting various multi-effects such that easy access to the multi-effects are available to the musician without having to use a floor pedal or having to stop playing in order to switch effects on a rack mount or table top unit. It is desirable for the keyboard to allow the signal processor to be programmed for many combinations and degrees of effects for later recall.

It is yet another object of the present invention to provide a single unit which is removably mountable on the guitar for programming, selecting and producing multi-effects without the fingers of the musician having to leave the strumming area, such that the musician is able to rapidly and conveniently change effects by selecting and altering the effects with his fingertips.

SUMMARY OF THE INVENTION

In accordance with a preferred embodiment of my invention, these and other objects and advantages are indicated as follows. A removably mountable multiple effects device for an electronic signal processor for an electric guitar which has an output socket includes a removably mountable container having a selection panel for accessing and selecting multiple effects from the signal processor contained therein. The selection panel is attached to a jack for plugging into the output socket of the guitar. A power supply supplies power to the signal processor and an output signal means for communicating signals is furthermore included.

While it is envisioned that micro-miniature multiple effects signal processors may be used to merely access various multiple effects, they may also be programmable. The selection panel is adapted to program the desired multiple effects. In addition, the multiple effects device may further comprise a combination jack for connection to a headphone set, a speaker mounted on the guitar, or it may be a combination plug simultaneously connecting an auxiliary output which is capable of receiving patch cords for connections to various external equipment for producing other multiple effects. Further in accordance with the invention, a combination plug which simultaneously connects an auxiliary output, headphones, and a speaker mounted on the surface is disclosed. The selection panel which is used to access and select multiple effects may take the form of a keyboard, or it may include a combination of a keyboard and several levers and buttons or dials.

In an attempt to accomplish the objects of the present invention. I disclose a removably mounted multiple effects device accessing a signal processor which can be removably mountable from a position which is within easy access to the fingers of the musician in order that the multiple effects desired may be accessed and selected rapidly and conveniently by the musician himself, rather than using floor pedals, which generally only access one effect. Tabletop or rack mount models generally must be run by a separate person, unless the musician himself stops playing and adjusts the tabletop or rack mounted electronic boxes. The musician is limited to the number of effects which can be manipulated by the foot on a floor pedal.

Most guitar playing styles generally afford musicians the time and opportunity to use one or more fingers of their strumming hand to be used to tap, strike or push buttons in order to select or change the effects currently being used while playing music. If the buttons, or other selection means that control the musical effect are placed sufficiently close to the fingers of the musician, the changes in effects can be made rapidly enough to become part of the guitar playing style. Therefore, it is advantageous to have the ability to change musical effects at a moment's notice while introducing the possibility of adding a new dimension to guitar playing. The characteristics of the guitar sound may be altered momentarily, so the signal processor may become an extension of the instrument itself.

The invention discloses four main embodiments as follows: (1) A multiple effects device being mounted on the face of the guitar in close proximity to the guitar strings which is an all-in-one unit to contain the electronic circuitry, the power supply, and the output signal means which is plugged into the output socket on the face of the guitar through a patch cord; (2) a multiple effects device mounted near the strumming fingers of the musician, said selection panel being attached to a main unit containing the electronic circuitry and the power supply, which is in turn connected into the output socket on the face of the guitar by a patch cord; (3) a keyboard or selection panel again mounted near the strumming fingers of the musician, said panel being attached by a patch cord to a main unit including the electronic circuitry, power supply and output signal means and having a jack for plugging into the output socket integral with the main unit; and (4) a single unit without the need for patch cords having the keyboard, electronic circuitry, power supply, and plug-in jack all in one integral piece which plugs directly into the output socket on the face of the guitar.

Further in accordance with the invention, the above objects are also reached by utilizing different output configurations for the jack which plugs into the output socket on the face of the guitar. In a first embodiment of the invention, the output plug or combination plug attached to the signal processor may include a connection to a headphone set so that the guitar may be operated by the musician while hearing the music being played without the use of a speaker-amplifier combination. In a second embodiment, the combination plug attached to the signal processor may include a connection to a speaker which is mounted on the front of the guitar to alleviate the need for an external speaker-amplifier combination. Yet a third embodiment may include an auxiliary output, headphones, and a speaker connection which are simultaneously plugged into the guitar by a combination plug. As may be realized by someone of ordinary skill in the art, the combination plug including such outputs may be connected to an external speaker-amplifier combination, or to various multi-effects signal processors, whether they are table-top or rack mount units.

BRIEF DESCRIPTION OF THE DRAWINGS

Other objects, features and advantages of the present invention will become apparent upon consideration of the specification and the appendant drawings, in which:

FIG. 1 is a top plan view of an electric guitar having an all-in-one unit including a selection panel, electronic circuitry, power supply and output signal means unit mounted on the face of the guitar with a patch cord connecting into the output socket of the guitar;

FIG. 2 is a top plan view of a similar electric guitar with the selection panel of the signal processor constructed in accordance with the present invention illustrating the selection panel and the circuitry configuration in separate units;

FIG. 3 is a view of yet another embodiment of the signal processor as mounted on the guitar;

FIG. 4 is a top plan view of a guitar with a perspective illustration of the single unit including the selection panel, electronic circuitry, and power supply; and FIG. 5 is a perspective view of a combination plug which may be utilized in accordance with the present invention for simultaneously connecting the selection panel, headphones, and auxiliary output to connect remote multi-effects signal processors, or amplifier-speakers.

DETAILED DESCRIPTION OF THE DRAWINGS

The construction of a removably mountable multiple effects device for holding an electronic signal processor for an electric guitar in accordance with the present invention will be explained by reference to a first embodiment which is shown in FIG. 1. In FIG. 1, an electric guitar is generally denoted by the numeral 10. Electric guitar 10 has a face 12 upon which a removably mountable multiple effects device 14 for a multiple effects signal processor is attached. Keyboard container 14 may be removably mounted by means of a clip, a velcro fixture, or any other conventional means for attaching an article to a face 12 of an electric guitar 10. Multiple effects device 14 may be mounted in close proximity to the strumming area 16 of electric guitar 10. Within the embodiment illustrated in FIG. 1, a signal processor is also included, within its housing, as well as electronic circuitry for interfacing-with the selection panel, a patch cord 18 connected to the multiple effects device and having a jack 20 at its end for plugging into an output socket 22 on the face 12 of the electric guitar 10. Further included within the keyboard container 14 may be a power source for supplying power to the signal processor and an output signal means for communicating signals. Keyboard container 14 includes keys or buttons 24 for accessing and selecting multiple musical effects. Buttons 24 may also include knobs, dials, levers, or any other convenient means of selecting multiple effects, such as would be known to one of ordinary skill in the art. FIG. 1 shows levers 25 as a possible configuration. Buttons 24, or any other configuration for selecting the multiple effects, must be designed so that it will fit on the face of the selection panel of the keyboard container 14. Within this embodiment, the electronic circuitry may be in communication with the signal processor so that combinations and degrees of multiple effects may be entered from the selection panel.

The multiple effects signal processor may be programmable, with a selection panel being able to program the electronic circuitry contained therein. Multiple effects device 14 may further comprise a combination jack plug for connection to a headphone set, a speaker mounted on the guitar, or an auxiliary output which is capable of receiving patch cords for connections to external equipment, such as the combination plug illustrated hereinbelow with reference to FIG. 5. The combination plug may be structured such that simultaneous connections for an auxiliary output, headphones, a speaker mounted on the surface, and the signal processor may be attached to the jack for plugging into the output socket on the face of the guitar.

Referring again to FIG. 1, the keyboard container 14 may include electronic circuitry such as electronic microprocessor-based circuitry. The circuitry may access effects which are selected from the group consisting of echo effects, distortion, phasing, compression, limiting, chorus, attack-decay, tremelo, sustain, stereo, noise gating and filtering. The signal processor may further comprise a drum sound generator.

With reference now to FIG. 2, a second embodiment of the present invention is illustrated which is similar to the construction of FIG. 1, with the exception of a separate housing 26 for containing the electronic circuitry, the power source, and the output signal means for communicating signals. Connecting cord 19 provides a means for electrical communication between the multiple effects device 14 and the housing 26. The housing 26 is then plugged into output socket 22 by patch cord 18 having a jack 20 at its end. The keyboard container 14 may also include a mounting means for attaching the signal processor to the face 12 of electric guitar 10. In this embodiment, the only difference between the embodiment illustrated in FIG. 1 and FIG. 2 is that the electronic circuitry and power source are contained in a separate housing 26 as opposed to the multiple effects device 14 of FIG. 1.

Looking now to FIG. 3, a third embodiment of the present invention is illustrated similar to the above two mentioned embodiments, with the exception of the electronic circuitry and power supply being contained in a housing 28 which is integral with a jack 20 for plugging into the output socket 22 on the face of the guitar (not shown in this Figure). A patch cord 18 provides electrical communication between housing 28 and keyboard container 14. There may also be a mounting means on the face of the guitar (not shown) for attaching the multiple effects device 14 to the face 12 of electric guitar 10. The mounting means will act to attach the selection panel on the surface of the guitar in an area convenient to the strumming fingers of the guitar player.

In all of the above mentioned embodiments of the present invention, the multiple effects device 14 includes a selection panel having keys or buttons 24 or levers 25 and may be made with a keyboard configuration or any other suitable design for easy access by the musician. The keyboard means would have a sufficient number of buttons or keys 24 to access, select and program multiple effects from electronic circuitry which may be included within the multiple effects device 14 itself, or as described more fully hereinbelow, the electronic circuitry may be further attached to a multiple effects tabletop or rack mount unit. Either way, the selection panel attached to multiple effects device 14 is adapted to be located in an area within easy access to the musician which will be capable of accessing and selecting multiple effects from the keyboard.

It is even possible to pluck a string or strings, with a pick or with one or more fingers, while simultaneously depressing a button 24 or lever 25 on the keyboard container. This is possible because the musician's fingers in the playing position. As an example of this simultaneous playing technique, we will describe a case in which the keyboard container is programmed to drop a played note by one octave when an assigned button or lever is depressed. By analyzing the incoming signal, it is possible to detect the component frequencies and generate various related sounds such as higher and lower notes separated by selected intervals. The related sounds can be generated synthetically or by replaying the actual samples waveform at various speeds. The musician can then simultaneously pluck a string and depress the assigned button or lever with preferably the ring or middle finger, although using any other free finger is possible. This playing would result in an interval being sounded which is equal to one octave and composed of the note from the string being plucked and from the sound generated from the signal processor dropping the played note one octave. Other intervals are possible such as a major third, a perfect fourth etc.

It is not required to pluck a string and depress a button or lever simultaneously as the sustained vibration of the string provides a signal to the signal processor for a reasonable amount of time after the string is plucked. Plucking a string and depressing a button or lever could be done alternately and possibly in rapid succession as if playing two strings alternately. This allows the signal processor to add either harmonic or melodic intervals. It should be observed from the above example that the button or lever on the signal processor can be played as though it is an additional string on the guitar. On a standard guitar, the string having the lowest pitched unfretted note is the sixth string and is usually tuned to an E note. If this string is played while depressing a button or lever or a signal process which is programmed to drop a note by some interval, for example an octave, it is possible to produce notes which are lower than those which the guitar by itself is capable of producing. It is even possible to produce notes which would ordinarily be produced by a standard bass guitar. Furthermore, the button or lever may be played by the musician's fingers as though it was an additional string which is programmable.

More than one lever or button may be available for playing by the musicians fingers. Each button or lever might have a different function, for instance, one button or lever might drop a note by an interval equal to a fifth while the other button or lever might drop the note by a third. Each lever or button could be positioned for access by different fingers while playing. Also, whole chords could be played and then transposed to a different key simply by depressing a button or lever. A triad could be strummed and a seventh could be added by depressing a button or lever. It is possible to strum a triad with the thumb or with a pick while simultaneously depressing a button or lever which adds a seventh, thereby creating a jazz sound to an ordinary triad.

With reference now to FIG. 4, yet another embodiment of the present invention is illustrated showing a one-piece unit 30 including a selection panel 32 having keys, buttons, or levers 34 for selecting and accessing multiple effects. Keys, buttons, or levers 34 may be used also to program miniature electronic circuitry which may be placed within the one-piece unit 30. An integral jack 36 attached to the one-piece unit 30 is adapted to be received by the output socket 22 on the face 12 of the electric guitar 10. Furthermore, one-piece unit 30 may include a power source for supplying power to the signal processor and an output signal means for communicating signals. The power source may include batteries, but may include any other power means. Although the selection panel or keyboard 32 is located at the base of the guitar 10 in this embodiment, it is still within easy reach of the fingers of the musician.

Looking now to FIG. 5, a combination plug is generally denoted by the numeral 40 which includes a jack 42 for plugging into the output socket 22 located on the face 12 of electric guitar 10. Combination plug 40 includes relatively short, flexible cables 44 and 45 which attach to auxiliary output socket 46 and stereo headphone socket 48, respectively. Cable 50 reaches to a keyboard container (not shown) which is removably mounted onto face 12 of electric guitar 10 in an area which is convenient to the strumming fingers of the guitar player. I further envision additional sockets simultaneously being connected in the combination plug and then plugged into output socket 22 by the jack plug. These additional sockets may receive plugs from any external equipment, such as an amplifier or other signal processors. Stereo headphone socket 48 may receive a set of headphones so that the guitar player may simultaneously play the guitar without the use of an amplifier in order to hear the true sound which he is producing. One of ordinary skill in the art may add further sockets for additional inputs which may be useful in the combination with the signal processor as described hereinabove with reference to FIGS. 1 through 4. The embodiments of the present invention which are detailed in the descriptions of FIGS. 1 through 4 may also include this combination plug 40 and any of its permutations. Further in accordance with the invention, an additional cable may emanate from combination plug 40 which will connect to a speaker mounted on the guitar or a patch cord for connection to any auxiliary equipment.

Further in accordance with the invention, an electric guitar is envisioned which includes a body and a face having a bridge, an output socket, strings and pick-up, and includes an improvement comprising a removably mountable, programmable multiple effects signal processor which includes a selection and programming panel, such as a keyboard means, for accessing, selecting and programming multiple effects from external effect devices. The selection panel may be mounted on the face of the guitar in an area convenient to the strumming fingers of the guitar player, and the signal processor may include a jack plug means for plugging directly into the output socket on the face of the guitar. The signal processor may take on several different configurations, including all-in-one units which include the keyboard means or selection panel, the electronic circuitry, an output signal means, or any other necessary components for operation.

Furthermore, a one-piece unit which includes a keyboard, a power source, and fully programmable electronic microprocessor circuitry capable of producing and programming multiple effects selected by the keyboard is in accordance with the present invention. The one-piece unit may have an integral jack plug means for plugging the one-piece unit into the output socket on the face of the guitar. The keyboard interfaces with the microprocessor circuitry and the output signal means so that any combination and degree of effects from the signal processor may be accessed, selected and programmed from the keyboard The one-piece unit is adapted for plugging directly into the output socket by the jack plug means.

While my invention has been described in terms of a few specific examples and configurations, it will be appreciated that other forms could readily be adapted by one skilled in the art. Accordingly, the scope of my invention is to be considered limited only by the following claims.

I claim:

1. A removably mountable multiple effects device for an electronic signal processor for an electric guitar, said electric guitar having an output socket, comprising:

a removably mountable keyboard container for accessing a multiple effects signal processor including a selection panel for accessing and selecting the multiple effects;

a patch cord connected to the signal processor;

a jack for plugging the patch cord into the output socket of the guitar; and a power source included in the multiple effects device for supplying power to the signal processor.

2. The multiple effects device of claim 1, wherein said multiple effects signal processor is programmable.

3. The multiple effects device of claim 1, further comprising an output socket for connection to a headphone set.

4. The multiple effects device of claim 1, further comprising an output socket for connection to a speaker mounted on the guitar.

5. The multiple effects device of claim 1, wherein said jack for plugging into the output socket on the guitar is a combination plug connected to an auxiliary output, said auxiliary output being capable of receiving patch cords for connections to external equipment.

6. The multiple effects device of claim 1, wherein said jack for plugging into the output socket on the guitar is a combination plug simultaneously connecting an auxiliary output, headphones, and a speaker mounted on the surface.

7. The multiple effects device of claim 1, further comprising a drum sound generator.

8. The multiple effects device keyboard container of claim 1, wherein said selection panel includes a keyboard means for accessing and selecting multiple effects, and wherein said power source is contained in a single unit attached to the guitar.

9. A removably mountable multiple effects device for an electronic signal processor for an electric guitar, said electric guitar having a surface and an output socket, comprising:

a removably mountable keyboard container for accessing a multiple effects signal processor including a selection panel for accessing and selecting multiple effects;

a mounting means for attaching said signal processor to the guitar;

a power source for supplying power to the signal processor;

said selection panel and power source being contained in a single unit;

a connecting cord for providing electrical communication between the multiple effects device and the power source; and a jack attached to the connecting cord for plugging into the output socket on the surface of the electric guitar.

10. The multiple effects device of claim 9, wherein said multiple effects signal processor is programmable.

11. The multiple effects device of claim 9, further comprising an output socket for connection to a headphone set.

12. The multiple effects device of claim 9, further comprising an output socket for connection to a speaker mounted on the guitar.

13. The multiple effects device of claim 9, wherein said jack for plugging into the output socket on the guitar is a combination plug connected to an auxiliary output, said auxiliary output being capable of receiving patch cords for connections to external equipment.

14. The multiple effects device of claim 9, wherein said jack for plugging into the output socket on the guitar is a combination plug simultaneously connecting an auxiliary output, headphones, and a speaker mounted on the surface.

15. The multiple effects device of claim 9, wherein said selection panel includes a keyboard means for accessing and selecting multiple effects.

16. The multiple effects device of claim 9, further comprising a mounting means for attaching the signal processor and the selection panel on the surface of the guitar in an area convenient to the strumming fingers of the guitar player.

17. A removably mountable multiple effects device for an electronic signal processor for an electric guitar, said electric guitar having a surface and an output socket comprising:

a removably mountable keyboard container for accessing a multiple effects signal processor including a selection panel for accessing and selecting multiple effects;

a mounting means for attaching said signal processor to the guitar;

a housing containing a power source, said housing including an integral plug for plugging the signal processor into the output socket on the surface of the guitar; and a patch cord for providing electrical communication between the multiple effects device and the housing.

18. The multiple effects device of claim 17, wherein said multiple effects signal processor is programmable.

19. The keyboard container of claim 17, wherein said mounting means attaches the signal processor and the selection panel on the surface of the guitar in an area convenient to the strumming fingers of the guitar player.

20. The keyboard container of claim 17, further comprising an output socket for connection to a headphone set.

21. The keyboard container of claim 17, further comprising an output socket for connection to a speaker mounted on the guitar.

22. The multiple effects device of claim 20, wherein said integral plug for plugging into the output socket on the guitar is a combination plug connected to an auxiliary output, said auxiliary output being capable of receiving patch cords for connections to external equipment.

23. The multiple effects device of claim 17, wherein said integral plug for plugging into the output socket on the guitar is a combination plug simultaneously connecting an auxiliary output, headphones, and a speaker mounted on the surface.

24. The multiple effects device of claim 17 wherein said selection panel includes a keyboard means for accessing and selecting multiple effects.

25. A removably mountable multiple effects device for an electronic signal processor for an electric guitar, said electric guitar having a surface with an output socket, comprising:

a one-piece unit containing a multiple effects signal processor and a power source for supplying power to the signal processor, said one-piece unit having a selection panel for accessing and selecting the multiple effects; and an integral jack plug for plugging the one piece unit into the output socket on the surface of the guitar.

26. The multiple effects device of claim 25, wherein said multiple effects signal processor is programmable.

27. The multiple effects device of claim 25, further comprising an output socket for connection to a headphone set.

28. The multiple effects device of claim 25, further comprising an output socket for connection to a speaker mounted on the guitar.

29. The multiple effects device of claim 25, wherein said integral jack plug for plugging into the output socket on the guitar is a combination plug connected to an auxiliary output, said auxiliary output being capable of receiving patch cords for connections to external equipment.

30. The multiple effects device of claim 25, wherein said integral jack plug for plugging into the output socket on the guitar is a combination plug simultaneously connecting an auxiliary output, headphones, and a speaker mounted on the surface.

31. The multiple effects device of claim 25, wherein said selection panel includes a keyboard means for accessing and selecting multiple effects.

32. A removably mountable multiple effects device for a signal processor for an electric guitar having a front face with an output socket, comprising:

a one-piece unit including a keyboard, a power source, and a jack plug for plugging the one-piece unit into the output socket on the face of the guitar, wherein said one-piece unit plugs directly into the output socket on the front face of the guitar by the jack plug.

* * * * *